US009774141B2

(12) United States Patent
Fukuhara et al.

(10) Patent No.: US 9,774,141 B2
(45) Date of Patent: Sep. 26, 2017

(54) ACCOMMODATION CONFIRMING STRUCTURE FOR ELECTRONIC COMPONENT, ELECTRICAL CONNECTION BOX, AND WIRE HARNESS

(71) Applicant: Yazaki Corporation, Tokyo (JP)

(72) Inventors: Yosuke Fukuhara, Shizuoka (JP); Takahiko Mitsui, Shizuoka (JP); Tatsuya Tsubouchi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/413,641

(22) Filed: Jan. 24, 2017

(65) Prior Publication Data

US 2017/0214183 A1 Jul. 27, 2017

(30) Foreign Application Priority Data

Jan. 25, 2016 (JP) ..... 2016-011327

(51) Int. Cl.
*H01R 13/641* (2006.01)
*H01B 7/00* (2006.01)

(52) U.S. Cl.
CPC ..... *H01R 13/641* (2013.01); *H01B 7/0045* (2013.01)

(58) Field of Classification Search
CPC . H01R 13/641; H01R 13/6272; H01R 13/465
USPC ..... 439/489, 488
See application file for complete search history.

(56) References Cited

U.S. PATENT DOCUMENTS 4,277,125 A * 7/1981 Ball ..... H01R 13/622 439/311
4,497,530 A * 2/1985 Shannon ..... H01R 13/622 439/312
4,534,607 A * 8/1985 Tomsa ..... H01R 13/622 439/312
4,674,814 A * 6/1987 Hoshino ..... H01R 13/62 439/372

(Continued)

FOREIGN PATENT DOCUMENTS

JP 2006-127960 A 5/2006

*Primary Examiner* — Gary Paumen
(74) *Attorney, Agent, or Firm* — Kenealy Vaidya LLP

(57) ABSTRACT

A structure includes an accommodation chamber, an accommodation confirming mechanism, and an operation space of the accommodation confirming mechanism. The accommodation confirming mechanism includes a first and second accommodation completion sound generating body. The first accommodation completion sound generating body is a projection body. The second accommodation completion sound generating body is an inclinable body configured to be inclined by being pressed by the inserted electronic component. The second accommodation completion sound generating body includes a receiving portion configured to receive a pressing force from a pressing portion of the electronic component and a leap portion configured to climb over the first accommodation completion sound generating body and generates the accommodation completion sound with the first accommodation completion sound generating body at a time when the electronic component is inserted to the accommodation completion position.

7 Claims, 7 Drawing Sheets

(56) References Cited

U.S. PATENT DOCUMENTS

| | | | | | |
|---|---|---|---|---|---|
| 4,915,643 | A * | 4/1990 | Samejima | H01R 13/6272 | 439/357 |
| 5,167,528 | A * | 12/1992 | Nishiyama | H01R 23/27 | 29/883 |
| 5,989,054 | A * | 11/1999 | Fasce | H01R 4/2433 | 439/358 |
| 6,457,991 | B1 * | 10/2002 | Yu | H01R 13/641 | 439/489 |
| 6,471,539 | B1 * | 10/2002 | Yu | H01R 13/641 | 439/489 |
| 7,351,095 | B2 * | 4/2008 | Olsen | H01R 13/641 | 439/488 |
| 7,445,492 | B2 * | 11/2008 | Hiramatsu | H01R 13/6272 | 439/489 |
| 2005/0112935 | A1 * | 5/2005 | Nimura | H01R 13/641 | 439/489 |

* cited by examiner

ACCOMMODATION CONFIRMING STRUCTURE FOR ELECTRONIC COMPONENT, ELECTRICAL CONNECTION BOX, AND WIRE HARNESS

CROSS-REFERENCE TO RELATED APPLICATION(S)

The present application claims priority to and incorporates by reference the entire contents of Japanese Patent Application No. 2016-011327 filed in Japan on Jan. 25, 2016.

BACKGROUND OF THE INVENTION

1. Field of the Invention

The present invention relates to an accommodation confirming structure for electronic component, an electrical connection box, and a wire harness.

2. Description of the Related Art

Electronic components (such as relays and connectors) usually have a terminal electrically connected with its counterpart terminal, and the terminals need to be connected with each other as designed to ensure conduction therebetween. However, the terminals are connected with each other in an accommodation chamber of the electronic component, and visually confirming whether a designed connection status is achieved is therefore difficult. As a solution, Japanese Patent Application Laid-open No. 2006-127960 describes such a technique that includes a pair of warped pieces provided on an inner wall surface of a female housing, a pressing portion provided on an exterior wall surface of a male housing that, upon connection between the connectors, presses the warped pieces and warps the pieces, and an impact portion provided on the exterior wall surface of the male housing that, when the warped pieces climb over the pressing portion, removes warp from the warped pieces and generates an impact sound by contacting with the pieces. In the technique, the impact sound notifies the user of completion of engagement between the connectors.

Size reductions of electronic components and their peripheral parts are being requested considering mountability onto vehicles and others. It is thus desired that a connection status between terminals be easily confirmed using as few components as possible without having a size increase of the device caused depending on a layout of the components or the like. From the above-described viewpoint, further improvement is necessary in methods of confirming a connection status between terminals.

SUMMARY OF THE INVENTION

The present invention therefore aims to provide an accommodation confirming structure for electronic component, an electrical connection box, and a wire harness that allow an easier confirmation of a connection status between terminals without increasing the size of the body.

In order to achieve the above mentioned object, an accommodation confirming structure for electronic component according to one aspect of the present invention includes an accommodation chamber configured to accommodate an electronic component; an accommodation confirming mechanism configured to generate an accommodation completion sound representing completion of accommodation of the electronic component into the accommodation chamber at a time when the electronic component is inserted to an accommodation completion position in the accommodation chamber; and an operation space configured to be used for operating the accommodation confirming mechanism and communicate with the accommodation chamber, wherein the accommodation confirming mechanism includes a first accommodation completion sound generating body and a second accommodation completion sound generating body that are configured to be separated from each other until the electronic component is accommodated in the accommodation chamber and that are configured to engage with each other and generate the accommodation completion sound at a time when the electronic component is inserted to the accommodation completion position, the first accommodation completion sound generating body is a projection body disposed in the operation space and projected in the operation space, and the second accommodation completion sound generating body is an inclinable body disposed in a manner projected from the operation space toward the accommodation chamber and configured to be inclined by being pressed by an inserted electronic component, the second accommodation completion sound generating body including a receiving portion configured to receive a pressing force from a pressing portion of the inserted electronic component and a leap portion configured to climb over the first accommodation completion sound generating body and generate the accommodation completion sound with the first accommodation completion sound generating body at a time when the electronic component is inserted to the accommodation completion position.

According to another aspect of the present invention, in the accommodation confirming structure for an electronic component, it is preferable that when the electronic component is likely to be inserted to the accommodation chamber in an inclined manner with respect to a direction of insertion to the accommodation chamber, the accommodation confirming mechanism is provided such that the pressing portion is disposed at least at each end side of the electronic component in a direction of inclination of the electronic component.

According to still another aspect of the present invention, in the accommodation confirming structure for an electronic component, it is preferable that when the electronic component has a plurality of terminals and is inserted into the accommodation chamber with the terminals simultaneously engaged with respective counterpart terminals, the accommodation confirming mechanism is provided such that the pressing portion is disposed at a position closer to a crowded area crowded with terminals out of the terminals.

According to still another aspect of the present invention, in the accommodation confirming structure for an electronic component, it is preferable that the accommodation confirming mechanism is provided such that the pressing portion is disposed at a center portion or at a gravity portion on a projection shape of the electronic component viewed from a direction of insertion to the accommodation chamber.

According to still another aspect of the present invention, an electrical connection box includes an electronic component accommodating body that includes an accommodation chamber for accommodating an electronic component; an accommodation confirming mechanism configured to generate an accommodation completion sound representing completion of accommodation of the electronic component into the accommodation chamber at a time when the electronic component is inserted to an accommodation completion position in the accommodation chamber; and an operation space configured to be used for operating the accommodation confirming mechanism and communicate with the accommodation chamber, wherein the accommodation confirming mechanism includes a first accommodation completion sound generating body and a second accommodation completion sound generating body that are configured to be separated from each other until the electronic component is accommodated in the accommodation chamber and that are configured to engage with each other and generate the accommodation completion sound at a time when the electronic component is inserted to the accommodation completion position, the first accommodation completion sound generating body is a projection body disposed in the operation space and projected in the operation space, and the second accommodation completion sound generating body is an inclinable body disposed in a manner projected from the operation space toward the accommodation chamber and configured to be inclined by being pressed by the inserted electronic component, the second accommodation completion sound generating body including a receiving portion configured to receive a pressing force from a pressing portion of the inserted electronic component and a leap portion configured to climb over the first accommodation completion sound generating body and generate the accommodation completion sound with the first accommodation completion sound generating body at a time when the electronic component is inserted to the accommodation completion position.

According to still another aspect of the present invention, a wire harness includes an electronic component; an electrical wire that is electrically connected to the electronic component; and an electrical connection box that includes an electronic component accommodating body including an accommodation chamber for accommodating the electronic component, an accommodation confirming mechanism configured to generate an accommodation completion sound representing completion of accommodation of the electronic component into the accommodation chamber at a time when the electronic component is inserted to an accommodation completion position in the accommodation chamber, and an operation space configured to be used for operating the accommodation confirming mechanism and communicate with the accommodation chamber, wherein the accommodation confirming mechanism includes a first accommodation completion sound generating body and a second accommodation completion sound generating body that are configured to be separated from each other until the electronic component is accommodated in the accommodation chamber and that are configured to engage with each other and generate the accommodation completion sound at a time when the electronic component is inserted to the accommodation completion position, the first accommodation completion sound generating body is a projection body disposed in the operation space and projected in the operation space, and the second accommodation completion sound generating body is an inclinable body disposed in a manner projected from the operation space toward the accommodation chamber and configured to be inclined by being pressed by the inserted electronic component, the second accommodation completion sound generating body including a receiving portion configured to receive a pressing force from a pressing portion of the inserted electronic component and a leap portion configured to climb over the first accommodation completion sound generating body and generate the accommodation completion sound with the first accommodation completion sound generating body at a time when the electronic component is inserted to the accommodation completion position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of an accommodation confirming structure for electronic component, an electrical connection box, and a wire harness according to the present invention will now be described with reference to the drawings. It should be noted that the embodiment is not intended to limit the present invention.

Embodiment

An embodiment of an accommodation confirming structure for electronic component, an electrical connection box, and a wire harness according to the present invention will now be described with reference to FIGS. 1 to 8.

Figure 1:
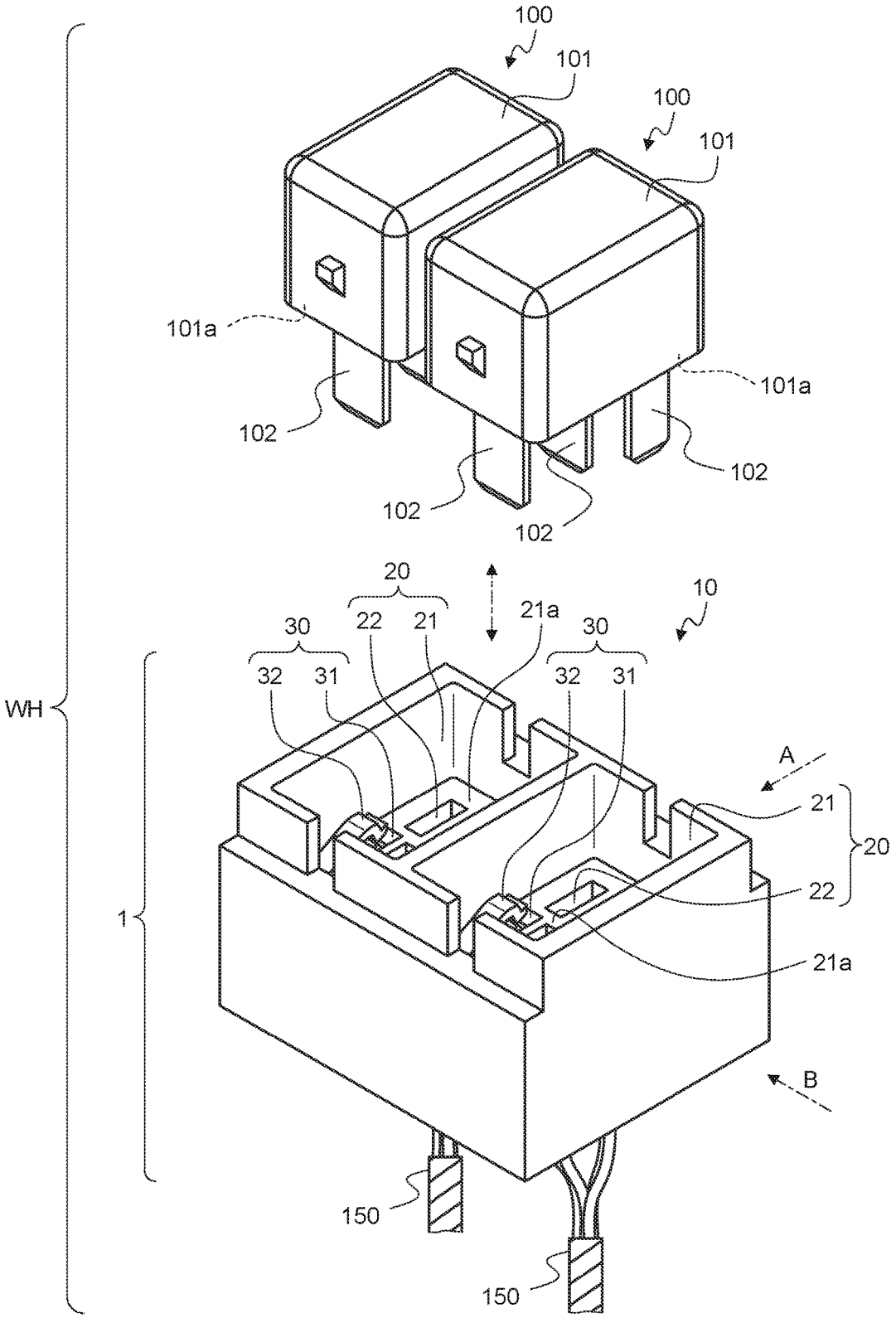
FIG. 1 is an exploded schematic drawing that illustrates an accommodation confirming structure for electronic component, an electrical connection box, and a wire harness of an embodiment.

A numeral 1 in FIG. 1 indicates an electrical connection box of this embodiment. A sign WH in FIG. 1 indicates a wire harness provided with the electrical connection box 1. The electrical connection box 1 of this embodiment accommodates and retains an electronic component 100 inside thereof and further has the electronic component 100 electrically connected to a connected object (not illustrated) through an electrical wire (such as an electricity supply line and a signal line) 150. The electrical connection box 1 forms the wire harness WH along with the electronic component 100 and the electrical wire 150.

Examples of the electronic component 100 include a circuit protection part such as a relay and a fuse and a connector. In this embodiment, examples of the electronic component 100 accommodated in the electrical connection box 1 further include an electronic apparatus such as an electronic control unit (an ECU). The electronic component 100 accommodates therein an electronic component body (not illustrated) (for example, a coil for a relay and a substrate for an electronic control unit) inside a housing 101. The electronic component 100 further includes a plurality of terminals 102 electrically connected to the electronic component body and to the electrical wire 150. The terminal 102 is molded into a male shape or a female shape from a conductive material such as a metal. In this example, a tab shape terminal 102 molded into a male shape is projected from a bottom 101*a* of the housing 101. Examples of the connected object include a power supply, a load, and a sensor. For example, the electrical connection box 1 is interposed between a power supply and a load with the electronic component 100 connecting therebetween. The wire harness WH provided with the electrical connection box 1 is mounted on a vehicle and the like and connected to a power supply (a secondary battery) and to an electronic apparatus (such as an actuator) serving as a load via the electrical wire 150.

Figure 2:
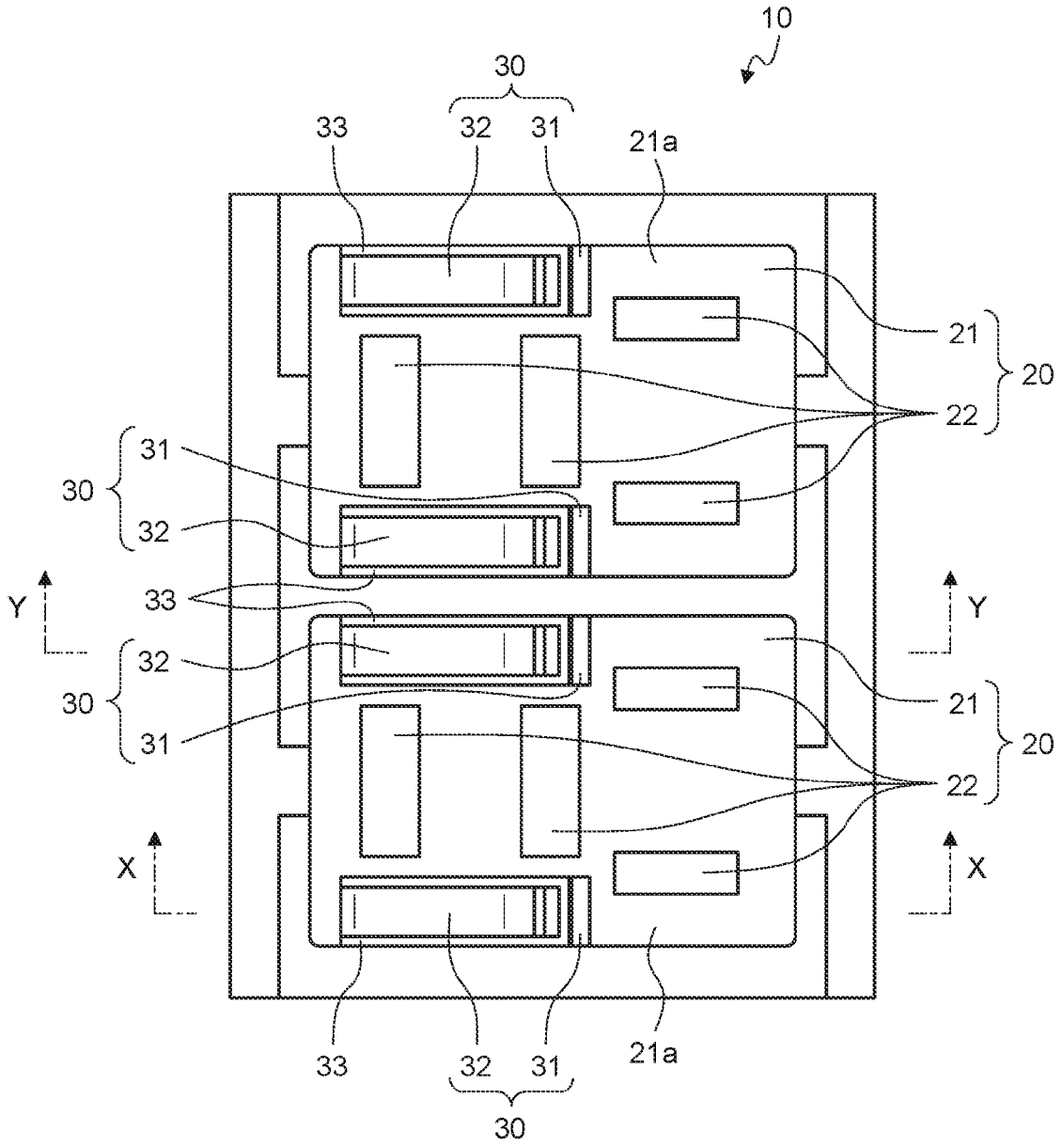
FIG. 2 is a top view of an electronic component accommodating body.
Figure 3:
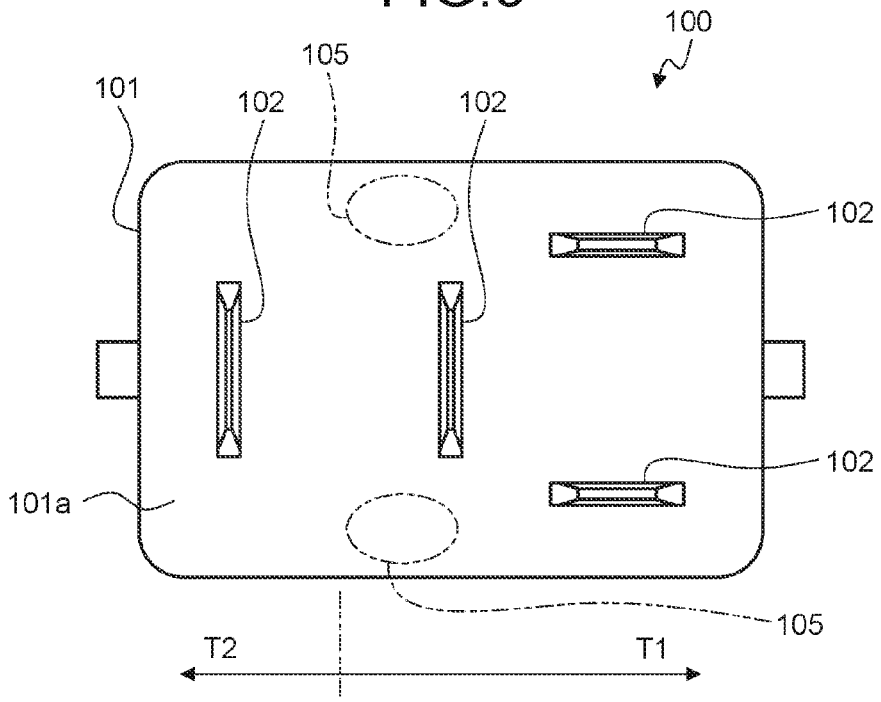
FIG. 3 is a bottom view of an electronic component.

The electrical connection box 1 in this embodiment includes an electronic component accommodating body 10 accommodating therein at least one electronic component 100. The electronic component accommodating body 10 has an accommodation chamber 20 for accommodating the electronic component 100 formed for each electronic component 100 (FIGS. 1 and 2). The electronic component accommodating body 10 is molded from an insulating material such as synthetic resin. For example, the electronic component accommodating body 10 may be formed as a housing of the electrical connection box 1 or may be configured with a housing of the electrical connection box 1 and an electronic component retaining member, detailed illustration of which is omitted. In the case with the former electronic component accommodating body 10, the accommodation chamber 20 is formed inside the housing. In the case with the latter electronic component accommodating body 10, the accommodation chamber 20 is formed in the electronic component retaining member, and the electronic component retaining member is accommodated in the housing of the electrical connection box 1 and retained thereby.

The accommodation chamber 20 of this embodiment includes a first accommodating portion 21 accommodating a housing 101 of the electronic component 100 and a second accommodating portion 22 accommodating a corresponding terminal 102 of the electronic component 100 individually. The first accommodating portion 21 has a bottom 21*a* contacting with the bottom 101*a* of the electronic component 100 in a manner facing the bottom 101*a* when the electronic component 100 is inserted to the accommodation completion position. The accommodation completion position is a position for accommodating the electronic component 100 in the accommodation chamber 20 and is particularly a position where the terminal 102 of the electronic component 100 and a terminal at an end of the electrical wire 150 are electrically connected with each other as designed. The second accommodating portion 22 is disposed in the bottom 21*a* side of the first accommodating portion 21 and communicates with the first accommodating portion 21 in the bottom 21*a* side. The electronic component 100 of this example has four terminals 102 (FIG. 3), and four second accommodating portions 22 are accordingly formed. For example, the second accommodating portion 22 accommodates therein a relay terminal (not illustrated) and retains the relay terminal. The terminal 102 of the electronic component 100 and a terminal (not illustrated) at an end of the electrical wire 150 are electrically connected to the relay terminal, which electrically connects between the terminal 102 of the electronic component 100 and the terminal of the electrical wire 150.

The electrical connection box 1 has a structure for confirming the connection status between the terminal 102 of the electronic component 100 and the relay terminal (in other words, between the terminal 102 of electronic component 100 and a terminal at an end of the electrical wire 150). Confirming the connection status is to determine whether the connection between the terminal 102 and the relay terminal is achieved as designed. However, the terminals are connected with each other inside the second accommodating portion 22, and with this structure of the electrical connection box 1, it is difficult to visually confirm the connection status between the terminals. However, determination of whether the terminals are connected with each other as designed is achieved by determining whether the electronic component 100 is being accommodated in the accommodation chamber 20 as designed. For example, in the electrical connection box 1, if the electronic component 100 is accommodated in the accommodation chamber 20 as designed, it is possible to determine that the terminal 102 of the electronic component 100 is electrically connected with its counterpart terminal (a relay terminal, in this case) as designed. On the other hand, if the electronic component 100 is accommodated in the accommodation chamber 20 not as designed, for example, if the electronic component 100 is accommodated in the accommodation chamber 20 in an inclined manner, it is possible to determine that the terminal 102 of the electronic component 100 is likely not to be electrically connected with the counterpart terminal as designed. The electrical connection box 1 of this embodiment therefore has a structure (that is, an accommodation confirming structure for the electronic component 100) for confirming how the electronic component 100 is accommodated in the accommodation chamber 20.

Figure 4:
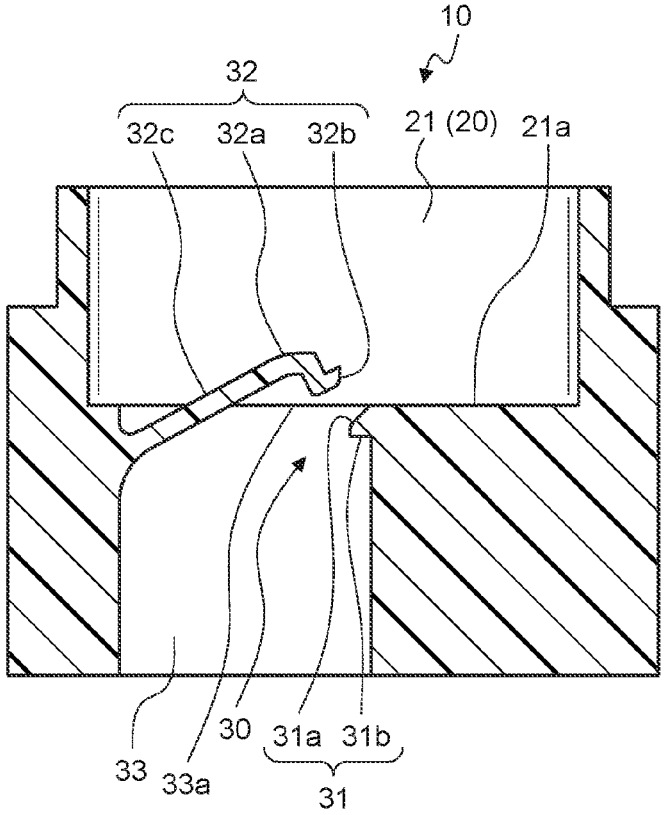
FIG. 4 is a cross-sectional view of the electronic component accommodating body along the lines X-X and Y-Y of FIG. 2.

The accommodation confirming structure includes the accommodation chamber 20 and an accommodation confirming mechanism 30 (FIGS. 1, 2, and 4). The accommodation confirming mechanism 30 is a mechanism that generates an accommodation completion sound representing that the electronic component 100 has been accommodated in the accommodation chamber 20 when the electronic component 100 is inserted to the accommodation completion position of the accommodation chamber 20 (in other words, when the electronic component 100 is inserted to a designed position of the accommodation chamber 20). Using the accommodation completion sound, how the electronic component 100 is accommodated in the accommodation chamber 20 can be confirmed.

The accommodation confirming mechanism 30 includes a first accommodation completion sound generating body 31 and a second accommodation completion sound generating body 32, which are separated from each other until the electronic component 100 is accommodated in the accommodation chamber 20. The accommodation confirming mechanism 30 starts operating when the electronic component 100 is inserted into the accommodation chamber 20 and is coming close to the accommodation completion position. When the electronic component 100 has been inserted to the accommodation completion position, the accommodation confirming mechanism 30 generates an accommodation completion sound and ends the operation. When the electronic component 100 has been inserted to the accommodation completion position, the first accommodation completion sound generating body 31 and the second accommodation completion sound generating body 32 are engaged with each other and generate the accommodation completion sound. The first accommodation completion sound generating body 31 and the second accommodation completion sound generating body 32 generate no accommodation completion sounds until the electronic component 100 has been inserted to the accommodation completion position.

More specifically, the accommodation confirming mechanism 30 is disposed in an operation space 33 provided inside the electronic component accommodating body 10 (FIGS. 2 and 4). The operation space 33 is a space used for operating the accommodation confirming mechanism 30. More specifically, the operation space 33 is a groove portion or a through-hole portion formed from the bottom 21*a* of the first accommodating portion 21 toward a direction in which the electronic component 100 is inserted. In this example, the operation space 33 is formed as a through-hole portion. The operation space 33 is formed on the bottom 21*a* in a manner avoiding positions where the second accommodating portions 22 are disposed and communicates with the first accommodating portion 21. The accommodation confirming mechanism 30 is disposed at an opening 33*a* provided in the bottom 21*a* side of the operation space 33.

The first accommodation completion sound generating body 31 is a projection body projected in the operation space 33 (FIG. 4). The first accommodation completion sound generating body 31 is projected from the side wall of the operation space 33 toward the inside of the operation space 33. For example, the first accommodation completion sound generating body 31 is gradually projected toward the direction in which the electronic component 100 is inserted. The first accommodation completion sound generating body 31 has a first wall surface 31*a* provided in the opening 33*a* side and a second wall surface 31*b* provided in the direction of insertion of the electronic component 100 side further than the first wall surface 31*a* The first wall surface 31*a* is an inclined surface of the first accommodation completion sound generating body 31 gradually projected toward the direction of insertion of the electronic component 100. The second wall surface 31*b* may be a plane perpendicular to the direction of insertion or may be an inclined surface with respect to the direction of insertion.

The second accommodation completion sound generating body 32 is an inclinable body disposed in a manner projected from the operation space 33 toward the first accommodating portion 21 in the accommodation chamber 20 and inclined by being pressed by an inserted electronic component 100.

The second accommodation completion sound generating body 32 has a receiving portion 32*a* (FIG. 4) that receives a pressing force from a pressing portion 105 (FIG. 3) on the bottom 101*a* of the inserted electronic component 100. The receiving portion 32*a* is positioned in the first accommodating portion 21 before the electronic component 100 is accommodated in the accommodation chamber 20.

The second accommodation completion sound generating body 32 further has a leap portion 32*b* disposed closer to the first accommodation completion sound generating body 31 compared with the receiving portion 32*a*. The leap portion 32*b* contacts with the first wall surface 31*a* of the first accommodation completion sound generating body 31 prior to insertion of the electronic component 100 to the accommodation completion position. When the electronic component 100 is inserted to the accommodation completion position, the leap portion 32*b* climbs over the first accommodation completion sound generating body 31 and generates an accommodation completion sound with the first accommodation completion sound generating body 31. The leap portion 32*b* has a first wall surface $\mathbf{32}b_1$ formed in the opening 33*a* side and a second wall surface $\mathbf{32}b_2$ formed in the opposite side to the direction of insertion of the electronic component 100 with respect to the first wall surface $\mathbf{32}b_1$ (the upper drawing of FIG. 5). The first wall surface $\mathbf{32}b_1$ has a curve surface contacting with the first wall surface 31*a* of the first accommodation completion sound generating body 31 upon insertion of the electronic component 100 into the accommodation chamber 20 and sliding along the first wall surface 31*a* with deeper insertion of the electronic component 100. In the state where the electronic component 100 has been inserted to the accommodation completion position, the second wall surface $\mathbf{32}b_2$ may be a plane perpendicular to the direction of insertion of the electronic component 100 or may be an inclined surface with respect to the direction of insertion of the electronic component 100.

The second accommodation completion sound generating body 32 further has a lever portion 32*c* projecting from the side wall of the operation space 33 and extending toward the receiving portion 32*a*. The lever portion 32*c* is a portion connecting between the side wall of the operation space 33 and the receiving portion 32*a* and formed with flexibility so as to be able to incline when the receiving portion 32*a* is pressed by the electronic component 100.

Figure 5:
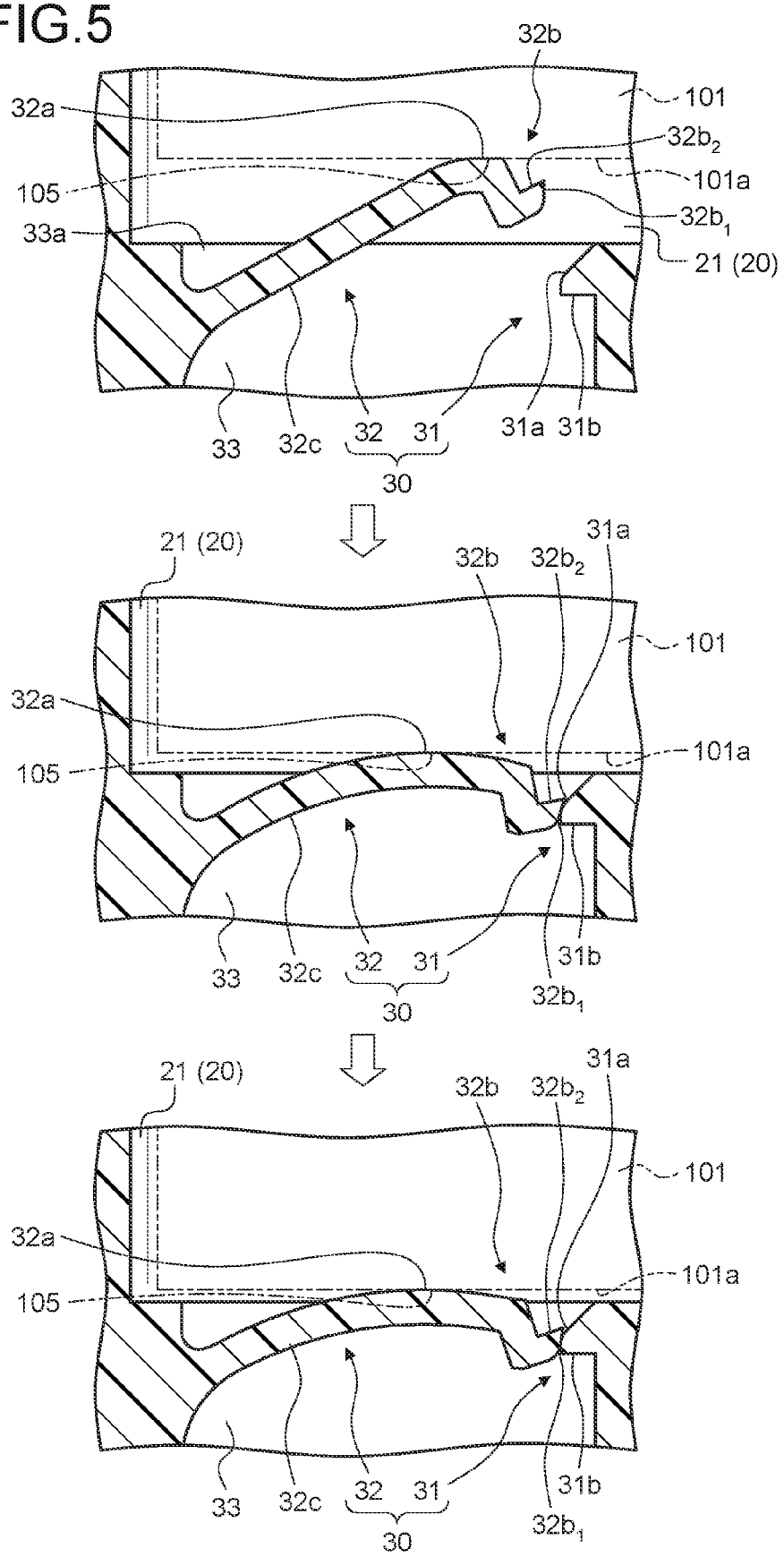
FIG. 5 are illustrative drawings of an accommodation confirming operation.
Figure 6:
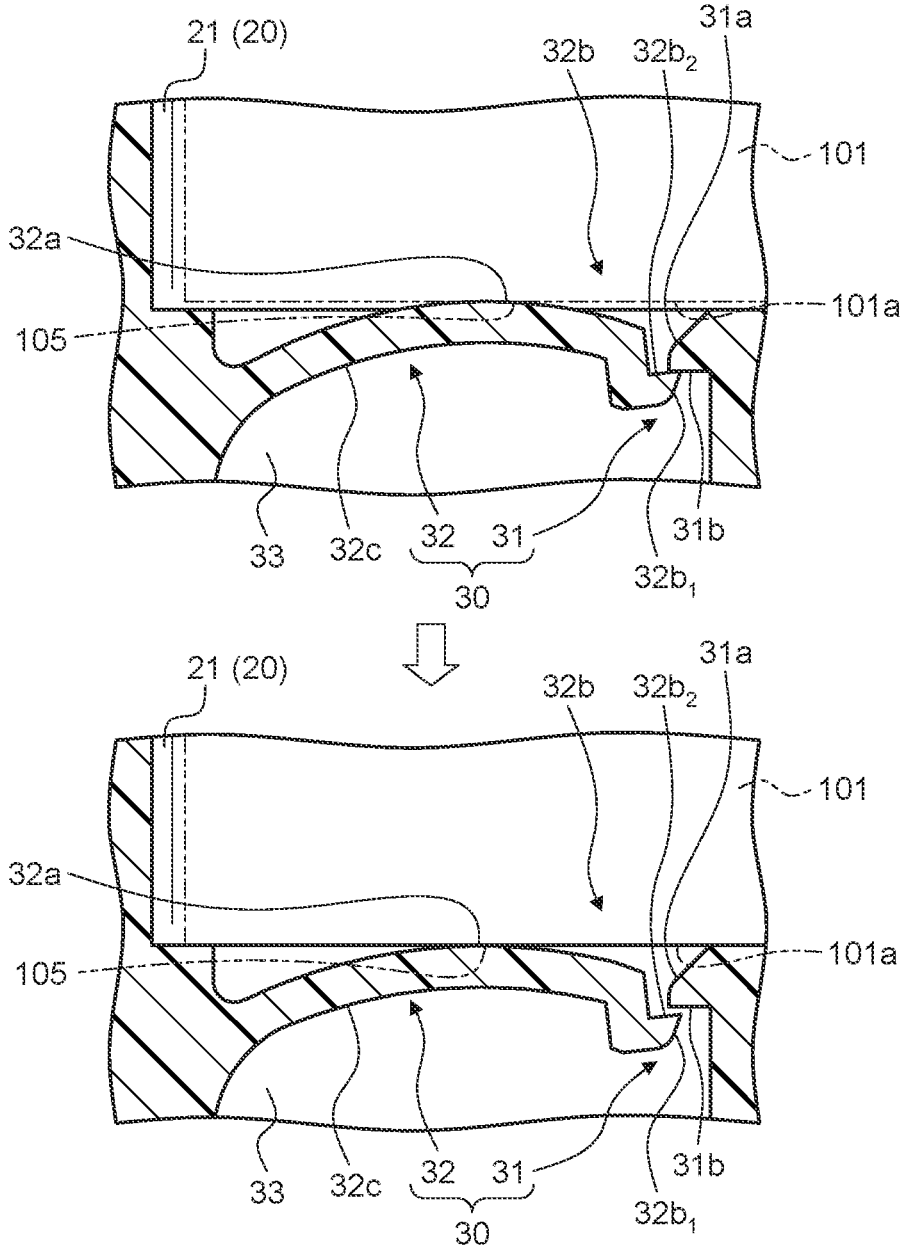
FIG. 6 are illustrative drawings of the accommodation confirming operation as a subsequent process of FIG. 5.

In this accommodation confirming structure, the electronic component 100 is inserted into the accommodation chamber 20, which makes the pressing portion 105 of the electronic component 100 contact with the receiving portion 32*a* of the second accommodation completion sound generating body 32 (the upper drawing of FIG. 5). Furthermore, in this accommodation confirming structure, the second accommodation completion sound generating body 32 is gradually inclined with deeper insertion of the electronic component 100, and the first wall surface $\mathbf{32}b_1$ of the leap portion 32*b* of the second accommodation completion sound generating body 32 contacts with the first wall surface 31*a* of the first accommodation completion sound generating body 31 (the middle drawing of FIG. 5). With deeper insertion, the second accommodation completion sound generating body 32 is gradually inclined while warping, and the first wall surface $\mathbf{32}b_1$ of the second accommodation completion sound generating body 32 slides along the first wall surface 31*a* of the first accommodation completion sound generating body 31 (the middle to the lower drawings of FIG. 5). With further deeper insertion, when the electronic component 100 has been inserted to the accommodation completion position, the leap portion 32*b* climbs over the first accommodation completion sound generating body 31 and generates an accommodation completion sound (the upper to the lower drawings of FIG. 6). With the leap portion 32*b* climbing over the first accommodation completion sound generating body 31, the warp of the second accommodation completion sound generating body 32 is removed. With this process, the second wall surface $\mathbf{32}b_2$ of the leap portion 32*b* of the second accommodation completion sound generating body 32 contacts with the second wall surface 31*b* of the first accommodation completion sound generating body 31 and generates an impact sound serving as the accommodation completion sound. In this accommodation confirming structure, a friction sound may be caused between the first accommodation completion sound generating body 31 and the leap portion 32*b* when the leap portion 32*b* climbs over the first accommodation completion sound generating body 31. This friction sound may also be used as the accommodation completion sound.

As described above, with the accommodation confirming structure for the electronic component 100 and the electrical connection box 1 of this embodiment, an accommodation completion sound is generated when the electronic component 100 is inserted to the accommodation completion position of the accommodation chamber 20. With this accommodation confirming structure for the electronic component 100 and the electrical connection box 1, an operator having the electronic component 100 accommodated can determine that the terminal 102 of the electronic component 100 and a relay terminal (more specifically, the terminal 102 of the electronic component 100 and a terminal at an end of the electrical wire 150) have been electrically connected with each other as designed using the accommodation completion sound without depending on a visual check. Furthermore, in the accommodation confirming structure for the electronic component 100 and the electrical connection box 1, the accommodation confirming mechanism 30 is placed in the operation space 33 provided inside the electronic component accommodating body 10. This layout can avoid an increase in the size of the electronic component accommodating body 10 (that is, the size of the electrical connection box 1). The accommodation confirming structure for the electronic component 100 and the electrical connection box 1 allow an easier confirmation of the connection status between terminals without increasing the size of the device. The wire harness WH of this embodiment includes the accommodation confirming structure for the electronic component 100 and the electrical connection box 1, and the same advantageous effects can be therefore exerted with the wire harness WH.

The insertion force of the electronic component 100 is affected by the degree of engagement when the leap portion 32*b* climbs over the first accommodation completion sound generating body 31 and by the degree of flexibility of the lever portion 32*c*. In this process, a smaller insertion force is not always advantageous. The insertion force can be used to give the operator a sense of moderation when the leap portion 32*b* climbs over the first accommodation completion sound generating body 31 (in other words, when the accommodation completion sound is generated). For example, the sense of moderation needs to be at a level with which the operator can recognize that the leap portion 32*b* has climbed over the first accommodation completion sound generating body 31. The accommodation confirming structure for the electronic component 100 provides the sense of moderation to the operator along with the accommodation completion sound so that the operator can more clearly determine the connection status between terminals. It is thus preferable that the degree of engagement when the leap portion 32*b* climbs over the first accommodation completion sound generating body 31 and the degree of flexibility of the lever portion 32*c* be set such that the sense of moderation in the climbing over is at an appropriate level for confirming the connection status between terminals. The sense of moderation can be varied by adjusting the amount of change in the insertion force for the amount of insertion of the electronic component 100 into the accommodation chamber 20.

Figure 7:
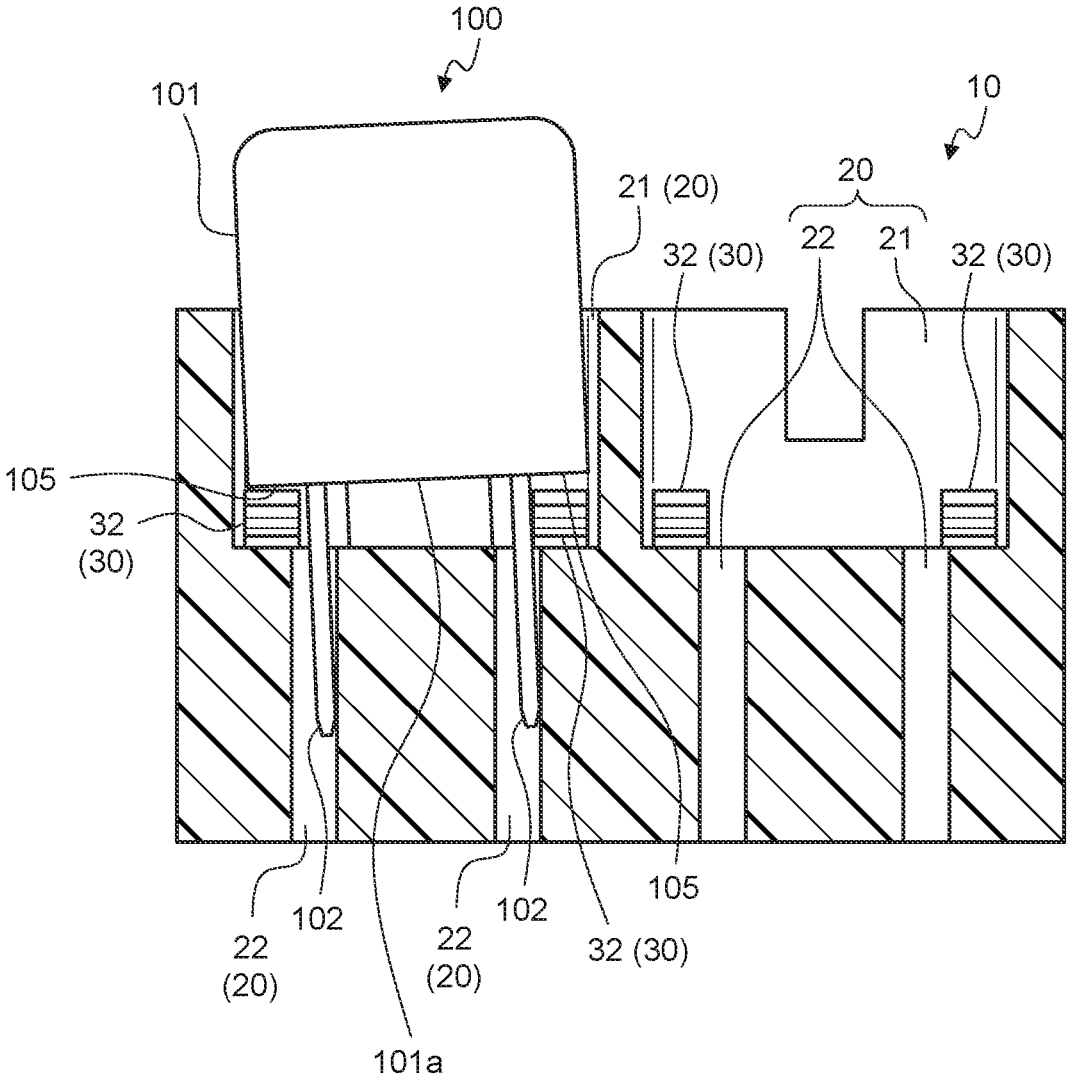
FIG. 7 is a drawing that illustrates a state of the electronic component inserted in an inclined manner when viewed from the direction of an arrow A of FIG. 1.

The accommodation chamber 20 is larger than the electronic component 100 so as to make the insertion operation of the electronic component 100 smooth. This configuration may problematically cause the electronic component 100 to be inserted into the accommodation chamber 20 in an inclined manner with respect to the direction of insertion (FIG. 7). If the electronic component 100 is inserted in an inclined manner, the operator may sense engagement at any timing of the insertion process of the electronic component 100. If the accommodation completion sound is generated in parallel with the sense of engagement, the operator may determine that the electronic component 100 has been inserted to the accommodation completion position. However, depending on the layout of the accommodation confirming mechanism 30, even when the accommodation completion sound is generated, the electronic component 100 is likely not to be inserted to the accommodation completion position. Considering that the electronic component 100 is likely to be inserted into the accommodation chamber 20 in an inclined manner with respect to the direction of insertion, the accommodation confirming structure is designed as follows.

For example, the accommodation confirming mechanisms 30 are provided such that the respective pressing portions 105 are disposed at least at respective end sides of the electronic component 100 in the direction of inclination (FIGS. 2 and 7). In this example, single accommodation confirming mechanism 30 is disposed at each end side of the electronic component 100. With the accommodation confirming structure for the electronic component 100 and the electrical connection box 1, even when one of the accommodation confirming mechanisms 30 generates an accommodation completion sound in response to the electronic component 100 inserted in an inclined manner, the operator can determine that the terminal 102 of the electronic component 100 and the relay terminal (more specifically, the terminal 102 of the electronic component 100 and a terminal at an end of the electrical wire 150) have not yet been electrically connected with each other as designed until the other accommodation confirming mechanism 30 generates the accommodation completion sound. With this accommodation confirming structure for the electronic component 100 and the electrical connection box 1, the connection status between terminals can be easily confirmed. Furthermore, in the accommodation confirming structure for the electronic component 100 and the electrical connection box 1, when the electronic component 100 is inserted without inclination, both accommodation confirming mechanisms 30 simultaneously generate larger accommodation completion sounds compared with the case that the accommodation confirming mechanisms 30 operate at different timings from each other. This configuration accordingly increases the sense of moderation caused when the leap portion 32*b* climbs over the first accommodation completion sound generating body 31 (in other words, when the accommodation completion sound is generated). In this manner, the connection status between terminals can be easily confirmed. The wire harness WH of this embodiment includes the accommodation confirming structure for the electronic component 100 and the electrical connection box 1, and the same advantageous effects can be therefore exerted with the wire harness WH.

Furthermore, if no terminals 102 or second accommodating portions 22 is disposed at a center portion or at a gravity portion on the projection shape of the electronic component 100 viewed from the direction of insertion into the accommodation chamber 20, the accommodation confirming mechanism 30 may be provided such that the pressing portion 105 is disposed at the center portion or at the gravity portion. In whatever manner the electronic component 100 is inclined when being accommodated in the accommodation chamber 20, with the bottom 101*a* corresponding to the center portion or the gravity portion contacting with the bottom 21*a* of the first accommodating portion 21, the electronic component 100 is accommodated in the accommodation completion position. Electrical connection with the counterpart terminal is therefore established as designed. In the accommodation confirming structure for the electronic component 100, the accommodation confirming mechanism 30 is provided such that the pressing portion 105 is disposed at the center portion or at the gravity portion of the electronic component 100. In whatever manner the electronic component 100 is inclined when being accommodated in the accommodation chamber 20, a designed connection status between terminals is therefore secured by keeping pushing the electronic component 100 until the accommodation completion sound is generated. With the accommodation confirming structure for the electronic component 100 and the electrical connection box 1, the connection status between terminals can be easily confirmed. The wire harness WH of this embodiment includes the accommodation confirming structure for the electronic component 100 and the electrical connection box 1, and the same advantageous effects can be therefore exerted with the wire harness WH.

Figure 8:
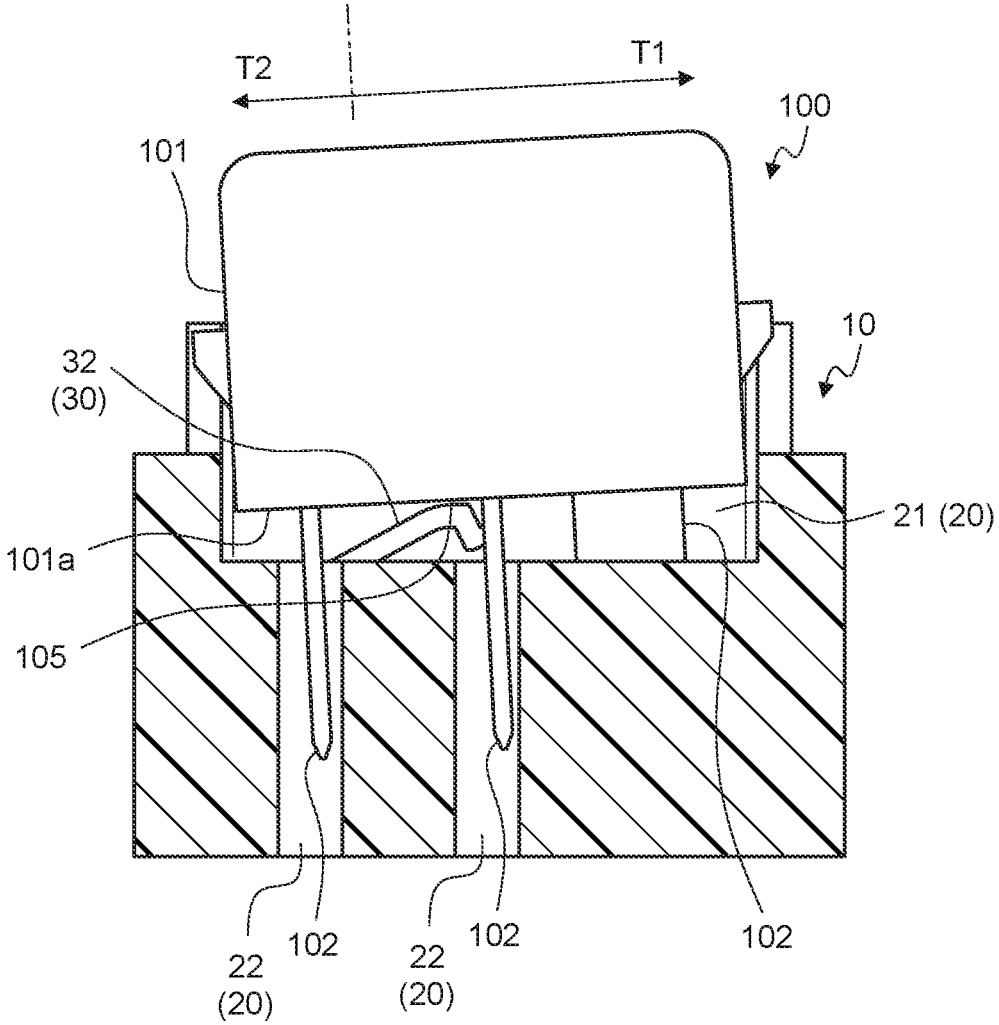
FIG. 8 is a drawing that illustrate a state of the electronic component inserted in an inclined manner when viewed from the direction of an arrow B of FIG. 1.

As described earlier, the electronic component 100 has a plurality of terminals 102. However, the terminals 102 are not always evenly or regularly aligned on the bottom 101*a*. In this case, the arrangement area for the terminals 102 of the electronic component 100 may be divided into a crowded area T1 relatively crowded with terminals 102 and a less crowded area T2 with relatively sparsely arranged terminals 102. When each terminal 102 is simultaneously engaged with its counterpart terminal, the crowded area T1 needs a larger insertion force than the less crowded area T2. The amount of insertion of the terminal 102 into the second accommodating portion 22 in the less crowded area T2 is therefore larger than the amount of insertion of the terminal 102 in the crowded area T1. This configuration may cause the electronic component 100 to be inserted into the accommodation chamber 20 in an inclined manner (FIG. 8). As a solution, when the electronic component 100 having a plurality of terminals 102 is inserted into the accommodation chamber 20 with the terminals 102 simultaneously engaged with the respective counterpart terminals, the accommodation confirming mechanism 30 is provided such that the pressing portion 105 is disposed at a position closer to the crowded area T1 crowded with the terminals 102. With this accommodation confirming structure for the electronic component 100, even when the electronic component 100 is accommodated into the accommodation chamber 20 with inclination caused due to the above-described reason, a designed connection status between terminals is secured by keeping pushing the electronic component 100 until the accommodation completion sound is generated. With the accommodation confirming structure for the electronic component 100 and the electrical connection box 1, the connection status between terminals can be easily confirmed. The wire harness WH of this embodiment includes the accommodation confirming structure for the electronic component 100 and the electrical connection box 1, and the same advantageous effects can be therefore exerted with the wire harness WH.

With the accommodation confirming structure for electronic component, the electrical connection box, and the wire harness, an accommodation completion sound is generated when the electronic component is inserted to an accommodation completion position in an accommodation chamber. This configuration enables an operator performing an accommodation work of the electronic component to determine that the terminal of the electronic component and the counterpart terminal have been electrically connected with each other as designed from the accommodation completion sound without depending on a visual confirmation on the status. In the accommodation confirming structure for electronic component, the electrical connection box, and the wire harness, a mechanism for confirming accommodation is placed in an operation space inside an electronic component accommodating body, which can avoid an increase in the size of the electronic component accommodating body (that is, the size of the electrical connection box). The accommodation confirming structure for electronic component, the electrical connection box, and the wire harness according to the embodiment allow an easier confirmation of the connection status between terminals without increasing the size of the device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An accommodation confirming structure for an electronic component, comprising:

an accommodation chamber configured to accommodate an electronic component;

an accommodation confirming mechanism configured to generate an accommodation completion sound representing completion of accommodation of the electronic component into the accommodation chamber at a time when the electronic component is inserted to an accommodation completion position in the accommodation chamber; and an operation space configured to be used for operating the accommodation confirming mechanism and communicate with the accommodation chamber, wherein the accommodation confirming mechanism includes a first accommodation completion sound generating body and a second accommodation completion sound generating body that are configured to be separated from each other until the electronic component is accommodated in the accommodation chamber and that are configured to engage with each other and generate the accommodation completion sound at a time when the electronic component is inserted to the accommodation completion position, the first accommodation completion sound generating body is a projection body disposed in the operation space and projected in the operation space, and the second accommodation completion sound generating body is an inclinable body disposed in a manner projected from the operation space toward the accommodation chamber and configured to be inclined by being pressed by an inserted electronic component, the second accommodation completion sound generating body including a receiving portion configured to receive a pressing force from a pressing portion of the inserted electronic component and a leap portion configured to climb over the first accommodation completion sound generating body and generate the accommodation completion sound with the first accommodation completion sound generating body at a time when the electronic component is inserted to the accommodation completion position.

2. The accommodation confirming structure for an electronic component according to claim 1, wherein, when the electronic component is likely to be inserted to the accommodation chamber in an inclined manner with respect to a direction of insertion to the accommodation chamber, the accommodation confirming mechanism is provided such that the pressing portion is disposed at least at each end side of the electronic component in a direction of inclination of the electronic component.

3. The accommodation confirming structure for an electronic component according to claim 1, wherein, when the electronic component has a plurality of terminals and is inserted into the accommodation chamber with the terminals simultaneously engaged with respective counterpart terminals, the accommodation confirming mechanism is provided such that the pressing portion is disposed at a position closer to a crowded area crowded with terminals out of the terminals.

4. The accommodation confirming structure for an electronic component according to claim 2, wherein, when the electronic component has a plurality of terminals and is inserted into the accommodation chamber with the terminals simultaneously engaged with respective counterpart terminals, the accommodation confirming mechanism is provided such that the pressing portion is disposed at a position closer to a crowded area crowded with terminals out of the terminals.

5. The accommodation confirming structure for an electronic component according to claim 1, wherein the accommodation confirming mechanism is provided such that the pressing portion is disposed at a center portion or at a gravity portion on a projection shape of the electronic component viewed from a direction of insertion to the accommodation chamber.

6. An electrical connection box comprising:

an electronic component accommodating body that includes an accommodation chamber for accommodating an electronic component;

an accommodation confirming mechanism configured to generate an accommodation completion sound representing completion of accommodation of the electronic component into the accommodation chamber at a time when the electronic component is inserted to an accommodation completion position in the accommodation chamber; and an operation space configured to be used for operating the accommodation confirming mechanism and communicate with the accommodation chamber, wherein the accommodation confirming mechanism includes a first accommodation completion sound generating body and a second accommodation completion sound generating body that are configured to be separated from each other until the electronic component is accommodated in the accommodation chamber and that are configured to engage with each other and generate the accommodation completion sound at a time when the electronic component is inserted to the accommodation completion position, the first accommodation completion sound generating body is a projection body disposed in the operation space and projected in the operation space, and the second accommodation completion sound generating body is an inclinable body disposed in a manner projected from the operation space toward the accommodation chamber and configured to be inclined by being pressed by the inserted electronic component, the second accommodation completion sound generating body including a receiving portion configured to receive a pressing force from a pressing portion of the inserted electronic component and a leap portion configured to climb over the first accommodation completion sound generating body and generate the accommodation completion sound with the first accommodation completion sound generating body at a time when the electronic component is inserted to the accommodation completion position.

7. A wire harness comprising:

an electronic component;

an electrical wire that is electrically connected to the electronic component; and an electrical connection box that includes an electronic component accommodating body including an accommodation chamber for accommodating the electronic component, an accommodation confirming mechanism configured to generate an accommodation completion sound representing completion of accommodation of the electronic component into the accommodation chamber at a time when the electronic component is inserted to an accommodation completion position in the accommodation chamber, and an operation space configured to be used for operating the accommodation confirming mechanism and communicate with the accommodation chamber, wherein the accommodation confirming mechanism includes a first accommodation completion sound generating body and a second accommodation completion sound generating body that are configured to be separated from each other until the electronic component is accommodated in the accommodation chamber and that are configured to engage with each other and generate the accommodation completion sound at a time when the electronic component is inserted to the accommodation completion position, the first accommodation completion sound generating body is a projection body disposed in the operation space and projected in the operation space, and the second accommodation completion sound generating body is an inclinable body disposed in a manner projected from the operation space toward the accommodation chamber and configured to be inclined by being pressed by the inserted electronic component, the second accommodation completion sound generating body including a receiving portion configured to receive a pressing force from a pressing portion of the inserted electronic component and a leap portion configured to climb over the first accommodation completion sound generating body and generate the accommodation completion sound with the first accommodation completion sound generating body at a time when the electronic component is inserted to the accommodation completion position.

* * * * *